United States Patent [19]

Faulkingham

[11] 4,093,112

[45] June 6, 1978

[54] FLAP POSITIONING ASSEMBLY

[76] Inventor: Clifford Henry Faulkingham, 3500 Heatherington Rd., Orlando, Fla. 32804

[21] Appl. No.: 784,061

[22] Filed: Apr. 4, 1977

[51] Int. Cl.[2] ..... B25C 7/00

[52] U.S. Cl. ..... 227/150; 269/254 CS

[58] Field of Search ..... 227/150, 151, 152; 269/254 CS, 47, 49; 53/381 R, 387; 93/49 R, 36 R, 36.7

[56] References Cited

U.S. PATENT DOCUMENTS

| | | | |
|---|---|---|---|
| 2,101,660 | 12/1937 | Vogel | 227/150 |
| 2,339,529 | 1/1944 | Unetic | 269/47 |
| 3,070,801 | 1/1963 | Schafroth | 227/150 |
| 3,116,487 | 1/1964 | Schick | 227/120 |
| 3,458,100 | 7/1969 | Faulkingham | 227/150 |

*Primary Examiner*—James F. Coan

*Attorney, Agent, or Firm*—Duckworth, Hobby, Allen & Pettis

[57] ABSTRACT

A flap positioning assembly of the type primarily designed to dispose the inner flap in substantially conventional containers into a position relative to the exterior flap so that stapling or otherwise securing of the flaps may be facilitated. A support frame includes a base plate and outwardly extending support arms having a clamp arm movable relative thereto by means of an orienting shaft capable of being manipulated to allow the clamp arm to be positioned in a clamped and non-clamped relation to the flaps of the container. Connecting linkage elements movably interconnect the orienting shaft to the base plate and a biasing element is interconnected to the plurality of linkage elements in a manner which biases the orienting shaft and the connecting clamp arm into either its clamped or non-clamped position so as to accomplish a substantially locking facility of the clamp into clamped relation with the flaps of the container wherein the flaps are disposed between the undersurface of the base plate and the clamp arm.

9 Claims, 4 Drawing Figures

FLAP POSITIONING ASSEMBLY

BACKGROUND OF THE INVENTION

1. Field of the Invention

This invention relates to a flap positioning assembly having a clamping structure movably attached thereto and positionable between a clamped and non-clamped position wherein linkage elements are provided to allow for movable disposition of the clamped facility relative to the container flaps such that stapling or otherwise securing of the flaps can be readily accomplished.

2. Description of the Prior Art

In the packaging industry the use of cardboard boxes is extremely common in that such containers have been found to be particularly applicable to a number of situations. Cardboard boxes are usually constructed or fashioned to provide a open end top. Four flaps extend from and are substantially integral with the four sides of the box at its upper extremity. These flaps are normally folded over to enclose the open end of the box. The opposite end of the box similarly comprises an open end and four flaps are likewise provided in integral connection with the box's four sides. The conventional procedure in joining the flaps together to encase the contents of the box has been to staple the flaps or otherwise mechanically interconnect these flaps together. Alternately, cardboard containers of this type have been closed by the flaps being mechanically held together by encircling wire or tape disposed around the major surfaces of the box.

It is recognized in the packaging industry, however, that when a cardboard container or carton is only partially filled, the contents thereof will not provide a proper supporting surface to enable the stapling or otherwise mechanical interconnection of the flaps by generally conventional or commercially available stapling machines. Accordingly, the problem exists of not being able to staple the overlapping flaps of a partially filled container.

In order to overcome this inherent problem, a number of stapling machines have been specifically designed to overcome this problem. Similarly, other devices have been provided to aid in the positioning of the flaps of the container to aid in the stapling or otherwise mechanically interconnecting of the flaps through the use of conventional stapling machines.

The U.S. Pat. Nos. to Vogel, 2,101,660, Schafroth, 2,764,758 and 2,770,804 are representative of disclosing structures wherein staple machines are particularly adapted or modified to include structural features aiding in the positioning of the flaps of a conventional container wherein the flaps may be stapled or otherwise mechanically interconnected to one another to effect closure of the container.

Similarly, the patents to Schafroth, U.S. Pat. No. 3,070,801 and Faulkingham, U.S. Pat. No. 3,458,100 also show specifically constructed devices capable of fitting on the interior of the container and disposed to position the flaps of the container so that stapling or otherwise mechanical interconnection can occur.

While all of the above set forth patents disclose operable structures, a number of these devices appear to be unnecessarily complex and complicated both in structure and operation. Accordingly, it would be highly desirable to provide a structure capable of efficiently and effectively positioning the flaps of the conventional cardboard type container with a tool or device which was low in cost and which is reliable and has low maintenance requirements. At the same time such a device should be capable of operation with minimum expertise or training required and in a simplified manner which further enables the operation of a stapling machine or the like of conventional design.

SUMMARY OF THE INVENTION

This invention relates to a flap positioning assembly of the type used in the stapling or otherwise mechanically securing together of flaps in a substantially conventional cardboard or like material container. To accomplish the proper positioning of the various flaps of the container, the subject invention comprises a support frame means including a base plate having a substantially elongated configuration. Support means in the form of at least one but preferably two or a plurality of support arms are fixedly attached to the base plate to extend laterally outwardly therefrom. In the preferred embodiment, the support arms are oppositely disposed but in colinear relation to one another and extend outwardly from the lateral edge of the base plate in substantially perpendicular relation to the longitudinal axis of the base plate. Both the undersurface of the base plate and the undersurface of the support arms are disposed to be positionable on the exterior surface of the container. More specifically, these structures form the "upper" supporting surface portions which engage the exterior surface of the container and, more specifically, the flaps of the container being clamped together.

The flap positioning assembly further comprises a positioning means in the form of a clamp arm having a substantially elongated configuration and being disposed to extend in substantial parallel relation to a predetermined portion of the support frame in general and the base plate in particular. An orienting shaft has one end fixedly connected to the clamp arm and is disposed to extend through the base plate by means of an aperture integrally formed in the base plate to allow for relative sliding engagement of the orienting shaft and the base plate. By virtue of this structure, the orienting shaft is disposed in substantially perpendicular relation to the plane defined by the base plate of the support frame means and is movable along its longitudinal axis in a reciprocal fashion so as to regulate the distance between the clamp arm and the undersurface of the base plate. The movement of the orienting shaft can be accomplished manually and thereby dispose the clamp arm between its clamped and non-clamped position at will.

Connecting means are further provided so as to movably interconnect the orienting shaft to the support frame means generally and the base plate in particular. The connecting means comprises a plurality of linkage elements having one end thereof pivotally interconnected to the base plate and the opposite end each pivotally connected to the orienting shaft. The clamped and non-clamped position are both defined by off-center positioning of the linkage elements wherein the linkage elements are arranged in angular orientation to one another. The center or aligned, substantially colinear position of the linkage elements is accomplished through interconnecting the ends of the linkage elements attached to the base plate by means of elongated slots which allow the movement thereof and the passage of the linkage elements from one off-center position which defines the clamped position to the opposite off-center position which defines the non-clamped position.

An important feature of the present invention is the provision by biasing means disposed in interconnecting relation to the linkage elements so as to serve to bias the linkage elements toward their off-center position and into either the clamped or non-clamped position. More specifically, the biasing means comprises a biasing element having its opposite ends interconnected to the pivotal points of attachment of the linkage elements to the support frame means. Accordingly, by virtue of this connection, the linkage elements are continually biased into angular orientation with one another and away from their center, substantially aligned, colinear orientation.

In order to facilitate the sliding movement of the orienting shaft relative to the base plate, a plastic or like material insert is disposed in an appropriately configured aperture formed integrally in the base plate itself. Similarly, an aperture which corresponds to the general cross-sectional configuration of the orienting shaft is formed in the plastic or like material insert so as to allow relative movement therebetween and to facilitate such movement and prevent binding which is more likely on a metal-to-metal surface such as would be the case if the insert were not present.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the subject invention, reference should be had to the following detailed description taken in connection with the accompanying drawings, in which.

Similar reference characters refer to similar parts throughout the several views of the drawings.

DETAILED DESCRIPTION

Figure 1:
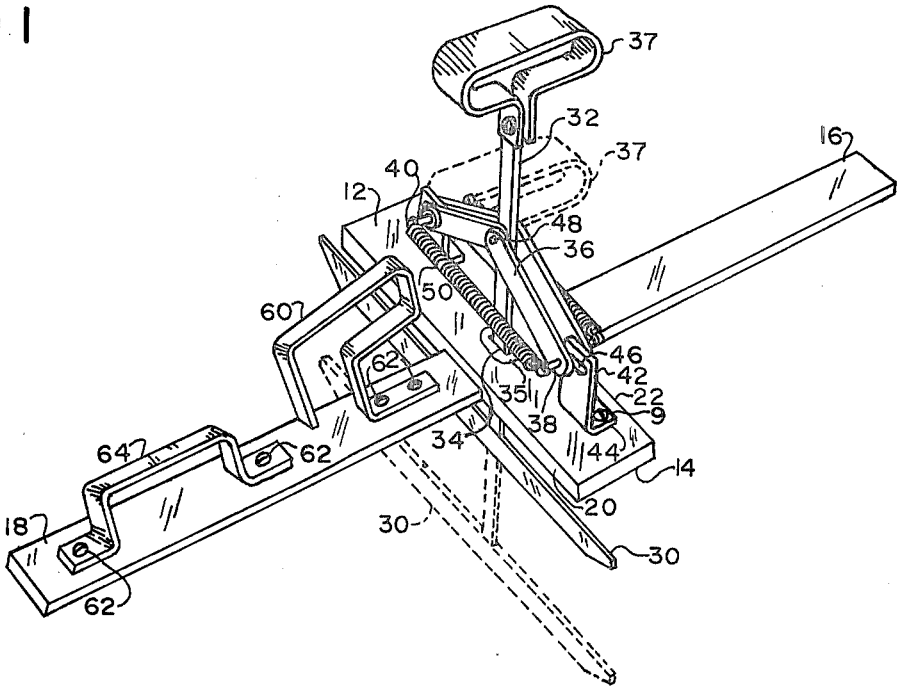
FIG. 1 is an isometric view showing the clamp arm in both its clamped and non-clamped position, the latter being represented in broken lines.
Figure 2:
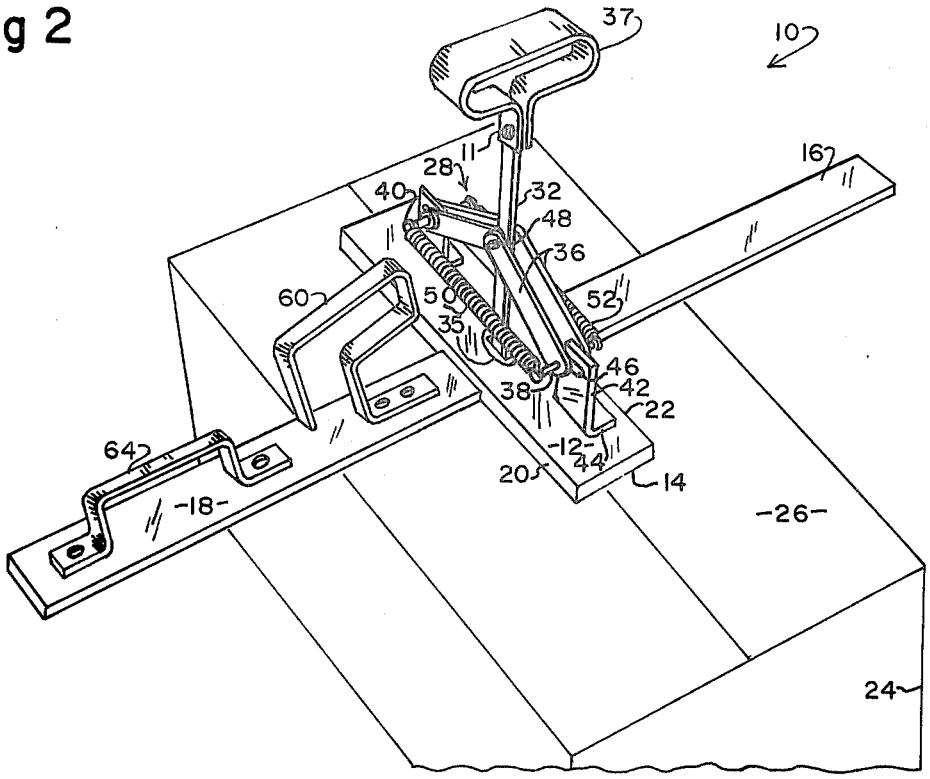
FIG. 2 is an upper, isometric view showing details of the biasing means and their attachment to the linkage elements of the present invention.
Figure 3:
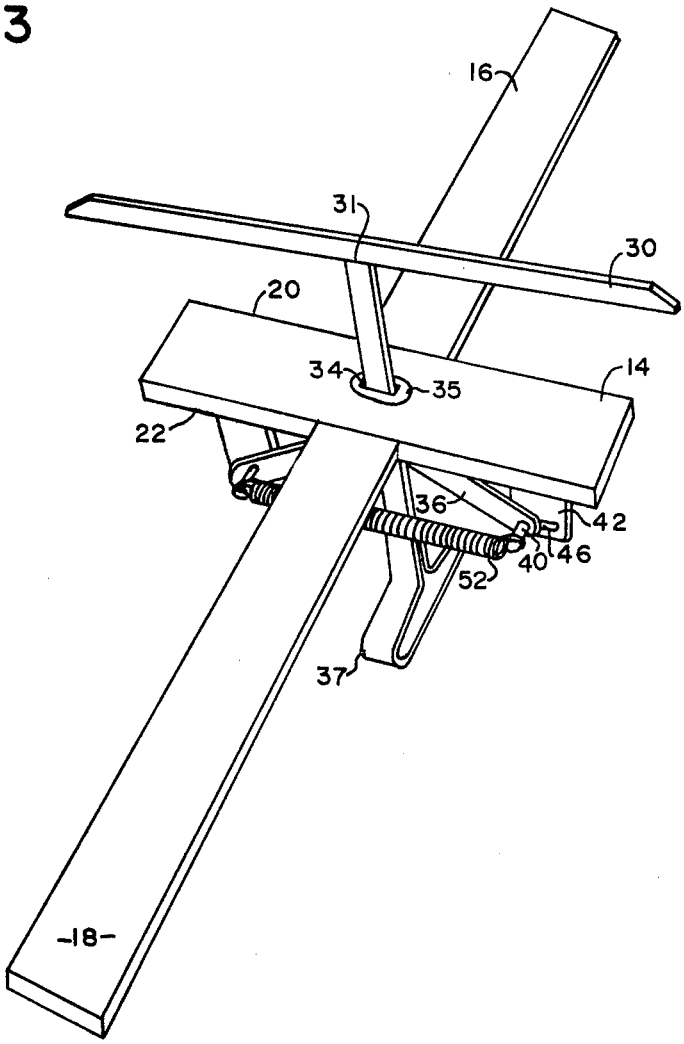
FIG. 3 is an under view showing details of the blade structure and its relation to the undersurface of the base plate.

With reference to FIG. 1, the flap positioning assembly of the present invention is generally indicated as 10 and comprises a support frame means including base plate 12 having a substantially elongated configuration and an undersurface 14. The support frame means further comprises support means in the form of at least one and preferably two support arms 16 and 18. The support arms 16 and 18 extend laterally outwardly from the longitudinal, lateral edges 20 and 22, respectively, at the base plate 12. As shown, the support arms 16 and 18 are substantially disposed in the same plane as the base plate 12 and are further disposed to support the remainder of the positioning assembly by being disposed on the exterior surface of the container 24 and outer flaps 26. See FIG. 2.

Positioning means generally indicated as 28 comprises clamp means in the form of a clamp arm 30 fixedly attached as at 31 to one end of an orienting shaft 32 which is movably interconnected to the base plate 12 and, more specifically, it extends therethrough. Extension of the orienting shaft 32 through the base plate 12 occurs by provision of an aperture means 34 integrally formed in an insert structure 35 mounted in the base plate and configured to allow sliding engagement between the orienting shaft 32 and the base plate 12 in a direction colinear to the longitudinal axis of the orienting shaft. An insert means in the form of the insert structure 35 may be fixedly mounted within the base plate 12 so as to be substantially coplanar therewith. The aperture 34 essentially is configured to correspond to the cross-sectional configuration of the orienting shaft 32 and allow sliding movement between the insert 35 and the orienting shaft 32. The insert may be made of a plastic or like material which is less likely to cause binding when the outer surface of the orienting shaft 32 frictionally engages the boundaries of aperture 34 formed in the insert structure 35. In addition, the provision of the insert may also be configured and even raised out of the plane of the base plate 12 so as to provide an effective stop when the ends of linkage elements 36, as at 48, forceably engage this insert. Naturally, at this point the downward movement of the orienting shaft 32 would be halted and the dimension of extension of the insert out of the plane of the base plate 12 will, to some extent, regulate the downward extension of the orienting shaft 32 and the downward displacement of the clamp arm 30.

Accordingly, movement of the orienting shaft in a reciprocal fashion serves to position the clamp arm 30 in either its clamped position shown in solid lines in FIG. 1 or its non-clamped position shown in broken lines in FIG. 1. Manipulation or positioning of the orienting shaft 32 in a direction along its longitudinal axis relative to the base plate 12 will, of course, serve to position the clamp arm 30 in either its clamped or non-clamped position. This manipulation can occur through grasping of conventional handle structure 37 attached at some point to the orienting shaft 32.

Connecting means serves to movably interconnect the orienting shaft 32 to the support frame in general and in particular the base plate 12. More specifically, the connecting means comprises a plurality of linkage elements 36 having opposite ends as at 38 and 40 pivotally attached to the support frame by means of flange members 42 secured to the upper surface of the base plate 12 as at 44 in substantially conventional fashion. Movable connection of the linkage elements 36 is allowed to occur relative to the brackets 42 through the provision of elongated slots or channels 46 which enables the linkage elements 36 to pass from their angular orientation defining the clamped position, as shown in FIG. 1 in solid lines, to their angular orientation, as represented in broken lines in FIG. 1, which defines the non-clamped position. The opposite ends of the linkage elements 36, of course, are pivotally connected to the orienting shaft as at 48. Passage of the linkage elements 36 from the clamped position to the non-clamped position, as described above, necessitates the linkage elements passing through a center position as defined by their aligned, substantially colinear relation to one another. Accordingly, the provision of the channels or slots 46 allows these linkage elements to pass through this aligned position to the opposite, off-center position to assume the desired position of the clamp arm 30 relative to the undersurface 14 of base plate 12.

The connecting means further comprises biasing means in the form of a biasing element 50 having a substantially elongated configuration and having its opposite ends connected to the pivotal points of connection 38 and 40 of the linkage elements 36. By virtue of this interconnection, the pivotal points 38 and 40 are biased towards one another so as to force and/or bias the linkage elements 36 into angular orientation relative to one another and into their off-center position as shown in solid and broken lines in FIG. 1, respectively. As set forth above, either of these off-center, angularly oriented positions of the linkage elements 36 define either the clamped or non-clamped position of the orienting shaft 32 and, of course, the attached clamp arm 30.

Yet additional structural features of the present invention comprise a grasping means including grasping handle 60 fixedly attached to one of the support arms 16 and/or 18 by conventional fasteners 62. Similarly, an auxiliary handle 64 may be similarly mounted to one of the support arms 18 as at 62 by the conventional fasteners indicated. These grasping handles are used to facilitate manipulation of the entire device and the proper positioning of the orienting shaft 32 and clamp arm 30 as demonstrated hereinafter.

Figure 4:
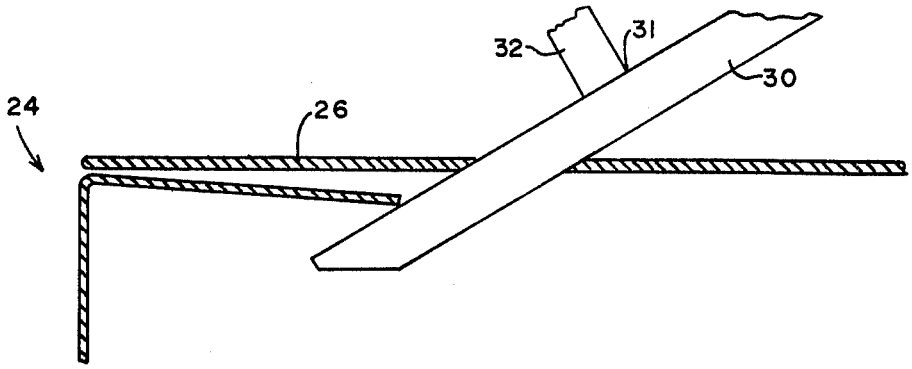
FIG. 4 is a representation of properly positioning the positioning assembly of the present invention at least partially on the interior of a container so as to properly position the flaps thereof.

In operation (FIG. 4), the orienting shaft 32 is depressed so as to move the linkage elements 36 into their lower, off-center position towards the base plate 12 which defines the maximum spaced apart distance between the clamp arm 30 and the undersurface 14 of the base plate 12. The clamp arm is then angled into an aperture between the exterior flaps of the container. The clamp arm is then leveled and disposed underneath the interior flaps such that the support arms 16 and 18 as well as the undersurface 14 of the base plate are disposed on the exterior surface of the container in engagement with the outer flaps 26. The orienting shaft 32 is then raised upwardly until the linkage elements are disposed in their angular orientation and upper offset position which positions the clamp arm 30 into the minimum spaced apart relation relative to the undersurface 14 of base plate 12. In such a position, the inner and outer flaps are clamped together in supported fashion to facilitate stapling or otherwise mechanically interconnecting the flaps.

It will thus be seen that the objects set forth above, among those made apparent from the preceding description, are efficiently attained, and since certain changes may be made in the above article without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A flap positioning assembly of the type primarily used to facilitate stapling of a container, said flap positioning assembly comprising: support frame means positionable at least in part on the exterior of the container and including a base plate, support means extending outwardly from said base plate; positioning means movably attached to said support frame means and including clamp means movably positionable in spaced apart relation to said base plate and comprising at least in part an elongated configuration, said clamp means further disposed in corresponding relation to said support frame means so as to securely engage a flap portion of the container between said support frame means and said clamp means; and connecting means movably interconnected between said positioning means and said support frame means and including a plurality of linkage elements pivotally connected between said positioning means and said base plate and disposed to at least partially define movement of said positioning means between a clamped and non-clamped position.

2. A flap positioning assembly as in claim 1 wherein said support means comprises at least two support arms extending laterally outwardly from said base plate and substantially coplanar therewith, said support arms disposable, with said base plate in supporting relation to the remainder of said positioning assembly on the exterior of the container.

3. A flap positioning assembly as in claim 1 wherein said positioning means comprises an orienting shaft attached to said clamp means and interconnected in movable, reciprocal manner along the longitudinal axis of said orienting shaft, relative to said support frame means, whereby said clamp means is reciprocal relative to said support frame means and positionable into clamping relation to a flap portion of the container.

4. A flap positioning assembly as in claim 3 wherein said clamp means comprises a clamp arm comprising a substantially elongated configuration and being attached to said orienting shaft and extending in a substantially parallel disposition relative to said base plate and positionable into reciprocal, spaced apart relation to the undersurface thereof, said clamp arm and said base plate disposed relative to one another so as to dispose a flap portion in clamped relation therebetween.

5. A flap positioning assembly as in claim 3 further comprising said orienting shaft disposed to extend and be movable through said base plate in substantially perpendicular relation to the longitudinal axis of said base plate, and in reciprocal manner along the longitudinal axis of said orienting shaft, said clamp means extending in substantially parallel relation to said base plate and positionable in reciprocal relation thereto upon manipulation of said orienting shaft, into clamping relation to a flap portion of the container.

6. A flap positioning means as in claim 1 further comprising an insert means connected to said plate and including aperture means formed therein and configured to surround said orienting shaft and substantially define the path of travel through said base plate, said insert disposable in substantially interruptive relation to the end of said linkage elements connected to said orienting shaft.

7. A flap positioning assembly as in claim 1 wherein said support frame means comprises a plurality of support arms at least two of which extend laterally outwardly from said base plate, said positioning means including an orienting shaft fixedly attached at one end to said clamp means and movable relative to said base plate along its longitudinal axis, said clamp means configured to extend substantially parallel to the longitudinal axis of said base plate and positionable into clamping relation to a flap portion of the container by predetermined spaced apart relation to the undersurface of said base plate.

8. A flap positioning assembly of the type primarily used to facilitate stapling of a container, said flap positioning assembly comprising: support frame means positionable at least in part on the exterior of the container and including a base plate, support means extending outwardly from said base plate; positioning means movably attached to said support frame means and including clamp means movably positionable in spaced apart relation to said base plate and comprising at least in part an elongated configuration, said clamp means further disposed in corresponding relation to said support frame means so as to securely engage a flap portion of the container between said support frame means and said clamp means; and connecting means movably interconnected between said positioning means and said support frame means and including a plurality of linkage elements pivotally connected between said positioning means and said base plate and disposed to at least partially define movement of said positioning means between a clamped and non-clamped position; said connecting means further comprising at least a biasing means interconnected between opposed portions of said linkage elements, said biasing means disposed to bias said linkage elements toward an off-center position relative to in-line orientation of said linkage elements, said off-center position defining a clamped and non-clamped position of said clamp means and said orienting shaft.

9. A flap positioning means as in claim 8 wherein said biasing means is movably interconnected to said plurality of linkage elements, said biasing means comprising a substantially elongated configuration interconnected at its opposite ends to said pivoted connections of opposite linkage elements to said base plate; said biasing means disposed to bias said pivoted connection and correspondingly positioned ends of said linkage elements toward one another.

* * * * *